US007983780B2

(12) United States Patent
Hirose

(10) Patent No.: US 7,983,780 B2
(45) Date of Patent: Jul. 19, 2011

(54) SEWING MACHINE

(75) Inventor: Hirokazu Hirose, Chiryu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 1163 days.

(21) Appl. No.: 11/716,611

(22) Filed: Mar. 12, 2007

(65) Prior Publication Data

US 2007/0227419 A1 Oct. 4, 2007

(30) Foreign Application Priority Data

Mar. 17, 2006 (JP) ..... 2006-074267

(51) Int. Cl.
*G06F 7/66* (2006.01)

(52) U.S. Cl. ..... 700/136; 112/470.04; 112/470.06

(58) Field of Classification Search ..... 700/136–138; 112/220, 314, 315, 319, 323, 324, 470.01, 112/470.04, 470.06
See application file for complete search history.

(56) References Cited

U.S. PATENT DOCUMENTS

| | | | | |
|---|---|---|---|---|
| 4,236,469 | A * | 12/1980 | Takenoya et al. | 112/314 |
| 4,368,683 | A * | 1/1983 | Takenoya | 112/314 |
| 4,823,715 | A * | 4/1989 | Horie et al. | 112/315 |
| 6,082,279 | A * | 7/2000 | Ito et al. | 112/314 |

FOREIGN PATENT DOCUMENTS

| | | |
|---|---|---|
| JP | B2 63-46711 | 2/1988 |
| JP | A 2000-24353 | 1/2000 |

* cited by examiner

*Primary Examiner* — Gary L. Welch
*Assistant Examiner* — Nathan E Durham
(74) *Attorney, Agent, or Firm* — Oliff & Berridge, PLC

(57) ABSTRACT

A sewing machine including an input unit that inputs a thread cut instruction; a thread cutting mechanism that cuts a needle thread and a bobbin thread based on the thread cut instruction; a feed dog vertically moving mechanism that vertically drives a feed dog for feeding a workpiece cloth; a feed dog activating switch unit that switches the feed dog between an active state in which the feed dog is vertically driven by the feed dog vertically moving mechanism and an inactive state in which an upper surface of the feed dog is positioned in a lowered position below an upper surface of a needle plate provided in a sewing machine bed; and a control unit that drives the thread cutting mechanism based on the thread cut instruction inputted from the input unit and that controls the feed dog activating switch unit to switch the feed dog to the inactive state in which the feed dog is positioned in the lowered position.

10 Claims, 16 Drawing Sheets

SEWING MACHINE

This application is based upon and claims the benefit of priority from the prior Japanese Patent Application 2006-074267, filed on, Mar. 17, 2006 the entire contents of which are incorporated herein by reference.

FIELD

The present disclosure is directed to a sewing machine that lowers a feed dog provided in a bed of a sewing machine below a needle plate by operating a feed dog activating switch unit provided that a needle thread and a bobbin thread has been cut by the thread cutting mechanism.

BACKGROUND

Conventionally, various types of sewing machines have been suggested that are provided with a feed dog lowering mechanism that lowers the feed dog below the needle plate to render the feed dog inoperable to execute cloth feed. Also, sewing machines have been suggested in which the feed dog lowering mechanism operates in synchronism with the presser foot lifting lever.

For example, the sewing machine described in JP S63-46711 A (hereinafter referred to as patent document 1), includes a feed dog lowering unit configured by a vertical feed arm; a vertical feed plate; and an engagement pin allowing disconnection of a connection between the vertical feed arm and the vertical feed plate and an engagement head of the engagement pin. In such sewing machine, operation of the presser foot lifting lever to lift the cloth presser moves a plurality of levers in synchronization therewith to consequently separate the engagement head of the engagement pin from an engagement hole of the vertical feed plate, thereby resulting in the lowering of the feed dog.

In the sewing machine described in patent document 1, the engagement head of the engagement pin is separated from the engagement hole of the vertical feed plate. At this time, the feed dog and the feed base to which the feed dog is secured is rapidly moved in synchronization with the operation of the presser foot lifting lever to lift the cloth presser, consequently causing an unpleasant rattling noise.

Moreover, the feed dog becomes switched to the lowered position every time the presser foot lifting lever is operated to lift the cloth presser regardless of whether the sewing operation is ongoing or completed. Since the rattling noise occurs on a consistent basis upon such operation of the presser foot lifting lever, the user may consider the noise indicative of a machine failure.

SUMMARY

An object of the present disclosure is to provide a sewing machine capable of switching a feed dog gently to a lowered position by a feed dog activating switch unit provided that a needle thread and a bobbin thread has been cut. It is also another object of the present disclosure to provide a sewing machine that allows smooth removal of the workpiece cloth from the sewing machine without being caught by the feed dog.

A sewing machine of the present disclosure includes an input unit that inputs a thread cut instruction; a thread cutting mechanism that cuts a needle thread and a bobbin thread based on the thread cut instruction; a feed dog vertically moving mechanism that vertically drives the feed dog for feeding a workpiece cloth; a feed dog activating switch unit that switches the feed dog between an active state in which the feed dog is vertically driven by the feed dog vertically moving mechanism and an inactive state in which an upper surface of the feed dog is positioned in a lowered position below an upper surface of a needle plate provided in a sewing machine bed; and a control unit that drives the thread cutting mechanism based on the thread cut instruction inputted from the input unit and that controls the feed dog activating switch unit to switch the feed dog to the inactive state in which the feed dog is positioned in the lowered position.

According to the above configuration, a control unit has been provided that controls the feed dog activating switch unit driving the thread cutting mechanism based on the thread cut instructions inputted by the input unit and switching the feed dog to the inactive state in which the feed dog is positioned in the lowered position. Thus, the feed dog is not switched to the lowered position on a frequent basis upon every instance of lifting the presser foot lifting lever to lift the cloth presser, but instead is switched to the lowered position upon placing/removing the workpiece cloth after cutting the needle thread and the bobbin thread by the thread cutting mechanism. Such configuration allows smooth transfer of the workpiece cloth without being caught by the feed dog.

BRIEF DESCRIPTION OF THE DRAWINGS

Other objects, features and advantages of the present disclosure will become clear upon reviewing the following description of the illustrative aspects with reference to the accompanying drawings, in which.

DETAILED DESCRIPTION

One embodiment example applying the present disclosure to an electronically-controlled zigzag sewing machine M (hereinafter simply referred to as a sewing machine) will be described with reference to the drawings.

Figure 1:
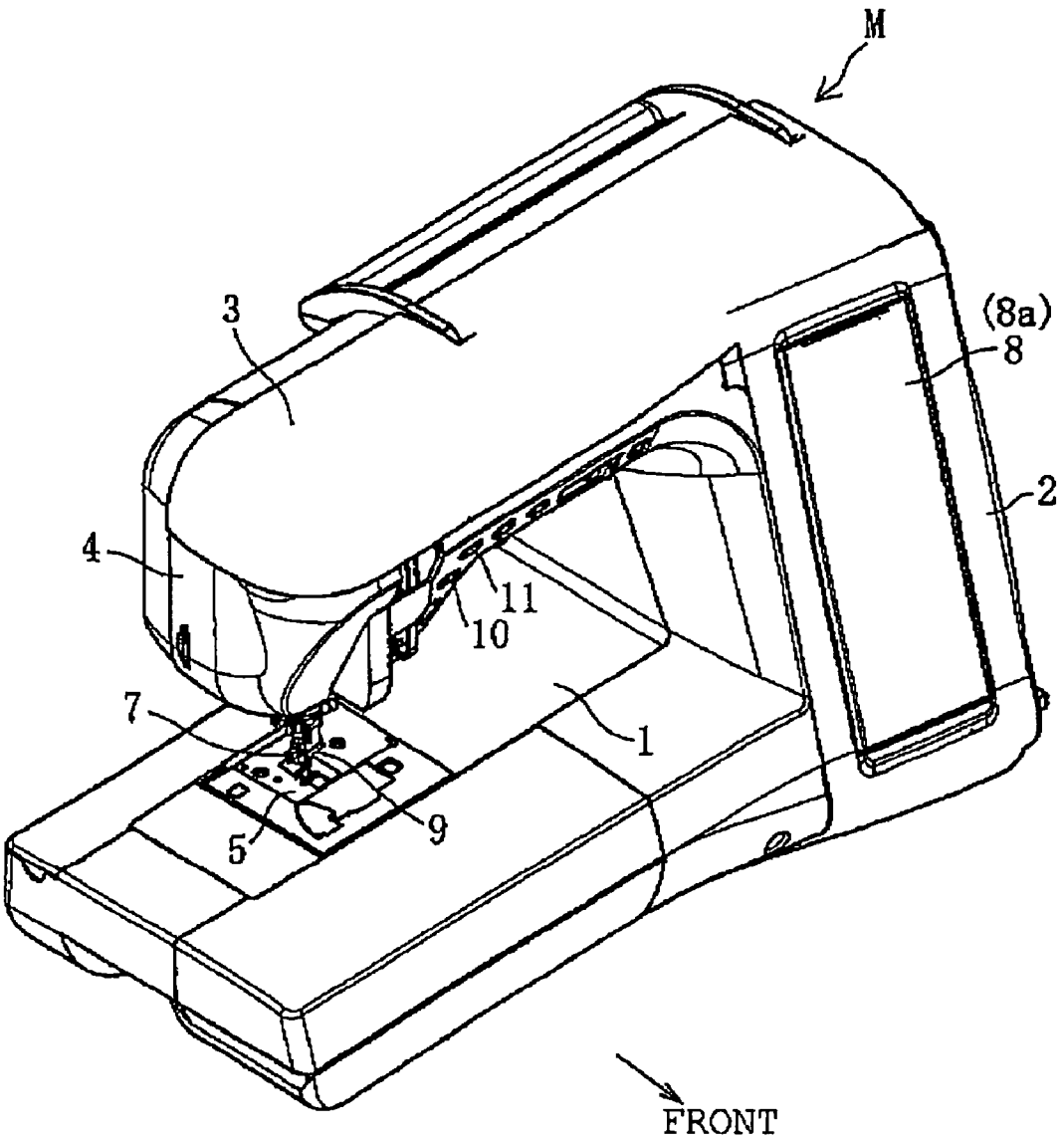
FIG. 1 is a perspective view of an electronically controlled zigzag sewing machine in accordance with one illustrative aspect of the present disclosure.

As shown in FIG. 1, the sewing machine M is similar to a general household electronic sewing machine. The sewing machine M includes a bed 1; a pillar 2 standing on the right end of the bed 1; an arm 3 extending leftward from the upper end of the pillar 2 so as to confront the bed 1; and a head 4 provided in the left portion of the arm 3.

A vertically-oriented liquid crystal display 8 is provided on the front face of the pillar 2; a plurality types of normal stitches such as utility stitches and decorative stitches are displayed on the liquid crystal display 8 upon pattern selection along with function names of various types of functions required for execution of a sewing operation and various types of guide messages, and the like. Thus, the sewing machine M is capable of sewing various types of utility stitches such as straight stitches and zigzag stitches and also various types of decorative stitches by combination of cloth teed and needle swing.

Provided in the front face of the liquid crystal display 8 is a transparent touch panel Ba having multiple touch keys. Thus, the user is allowed to readily select a pattern by merely pressing a touch key corresponding to the desired stitch to be sewn from a plurality types of normal stitch patterns. Also, the desired function can be executed by merely pressing the touch key corresponding to the function name.

The arm 3 is provided with a laterally oriented sewing machine main shaft (not shown) rotationally driven by a sewing machine motor (refer to FIG. 16), and a hand pulley (not shown) allowing manual rotation by the user to rotate the sewing machine main shaft. The arm 3 further includes a needle bar drive mechanism (not shown) for vertically moving a needle bar (not shown) having a sewing needle 7 attached to the lower end of the arm 3; a needle swing mechanism (not shown) for laterally swinging the needle bar in a direction perpendicular to the cloth feed direction; and a thread take-up drive mechanism (not shown) for vertically moving the thread take-up in synchronization with the vertical movement of the needle bar.

The head 4 has vertically disposed therein a presser bar (not shown) parallel to the needle bar and a presser foot 9 is mounted attachably/detachably to the lower end of the presser bar. A presser foot operating lever (not shown) is provided in the rear side of the head 4 and the operation of the presser foot allows switching of the presser bar between the lowered position and the raised position. In such case, an operating lever position detection sensor 73 (refer to FIG. 16) capable of detecting the vertical position of the presser foot operating lever is provided on the frame of the arm 3.

Provided in the front face of the arm 3 are various switches such as a start/stop switch 10 instructing start and stop of sewing operation, and a thread cut instruction switch 11 instructing thread cutting operation. The needle bar drive mechanism is driven in synchronization with the sewing machine main shaft driven by a sewing machine motor 74, and the needle swing mechanism is driven by a needle bar swing motor 75 (refer to FIG. 16).

Referring to FIGS. 2 to 6, a laterally oriented lower shaft 20 is disposed inside the bed 2 and pivoted rotatably to the sewing machine frame (not shown). Provided in the left end of the lower shaft 20 are a horizontal rotary shuttle 28, a cloth feed unit 12, a feed dog activating switch unit 13, and a thread cutting mechanism 14 (refer to FIG.9). The cloth feed unit 12 drives the feed dog 6 in the longitudinal and lateral directions. The feed dog activating switch unit 13 switches the feed dog 6 so as to be retained in the lowered position. The thread cutting mechanism 14 cuts the needle thread and the bobbin thread.

Next, a description will be given on the cloth feed unit 12 provided in the bed 1. The cloth feed unit 12 includes a feed dog vertically moving mechanism 15 for vertically driving the feed dog 6, and a feed dog longitudinally moving mechanism (not shown) for moving the feed dog 6 in the longitudinal direction. The feed dog vertically moving mechanism 15 will be described hereinafter.

Figure 2:
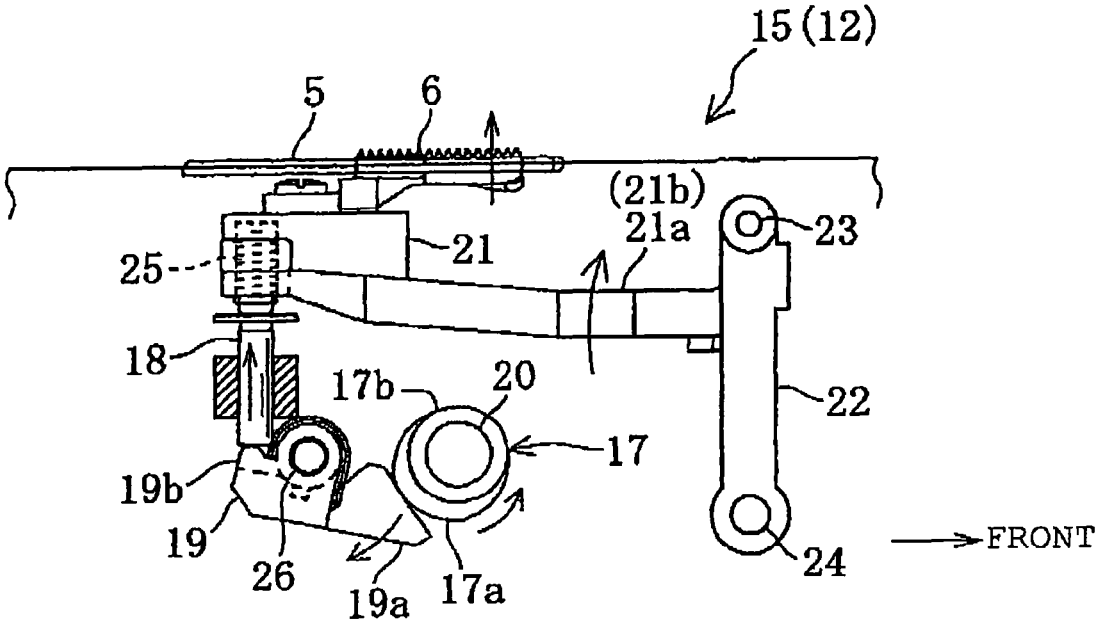
FIG. 2 is a left side view of a feed dog vertically moving mechanism when a feed dog is in an upper position.
Figure 3:
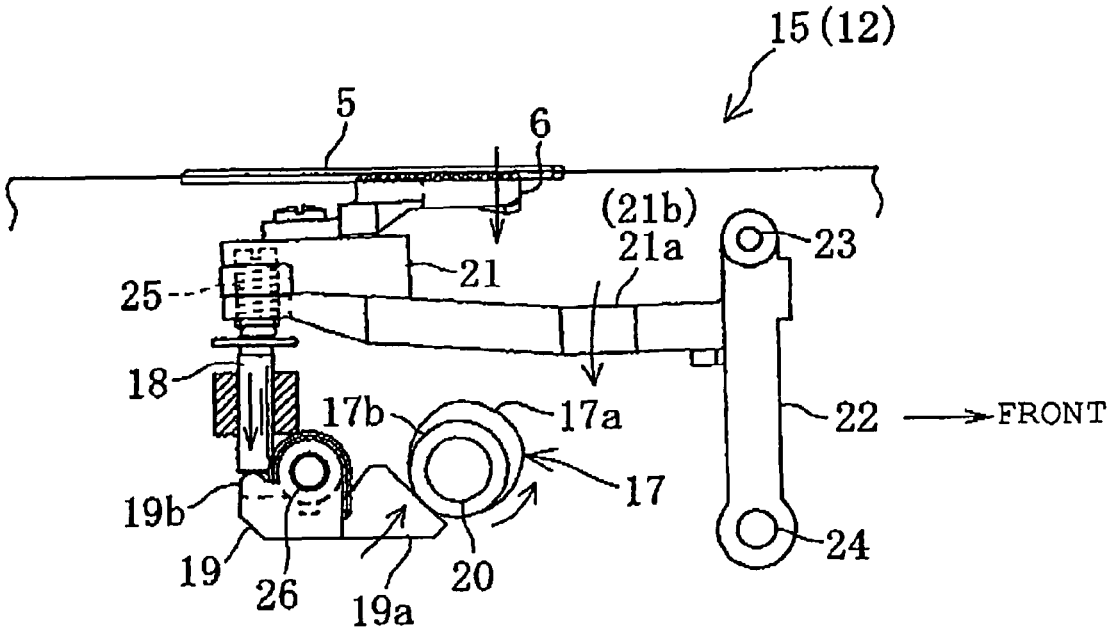
FIG. 3 is a left side view of the feed dog vertically moving mechanism when the feed dog is in a lower position.
Figure 4:
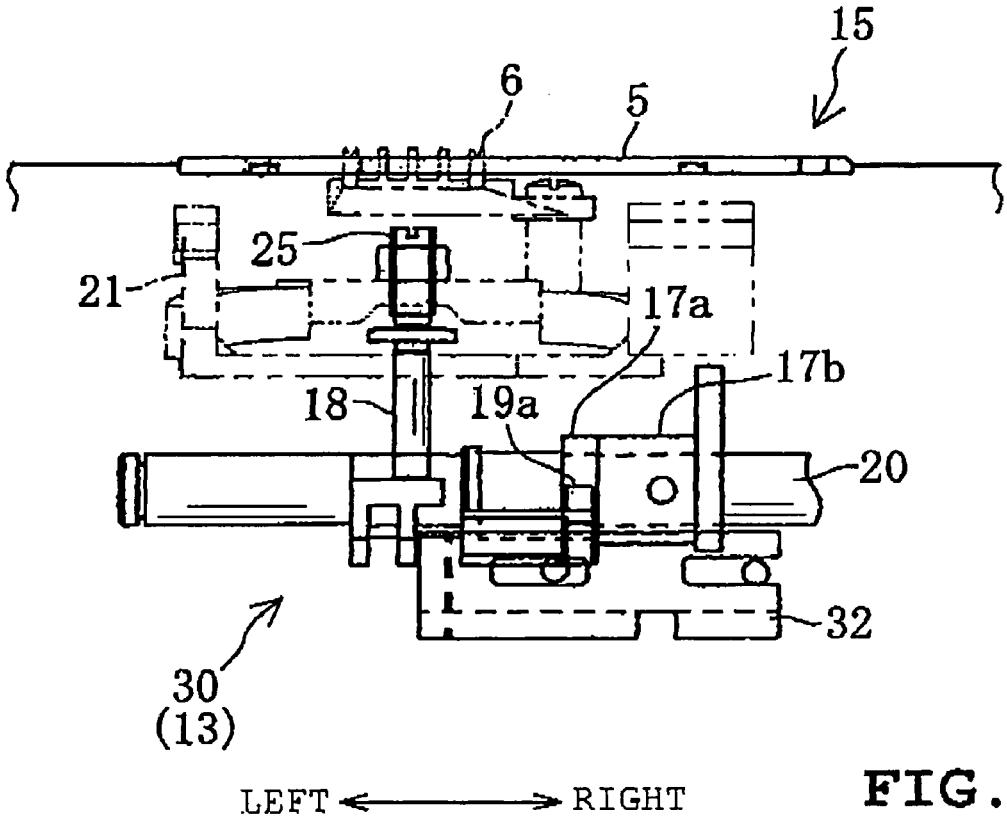
FIG. 4 is a front view (cloth feed state) of the feed dog vertically moving mechanism and a feed dog switching mechanism.
Figure 5:
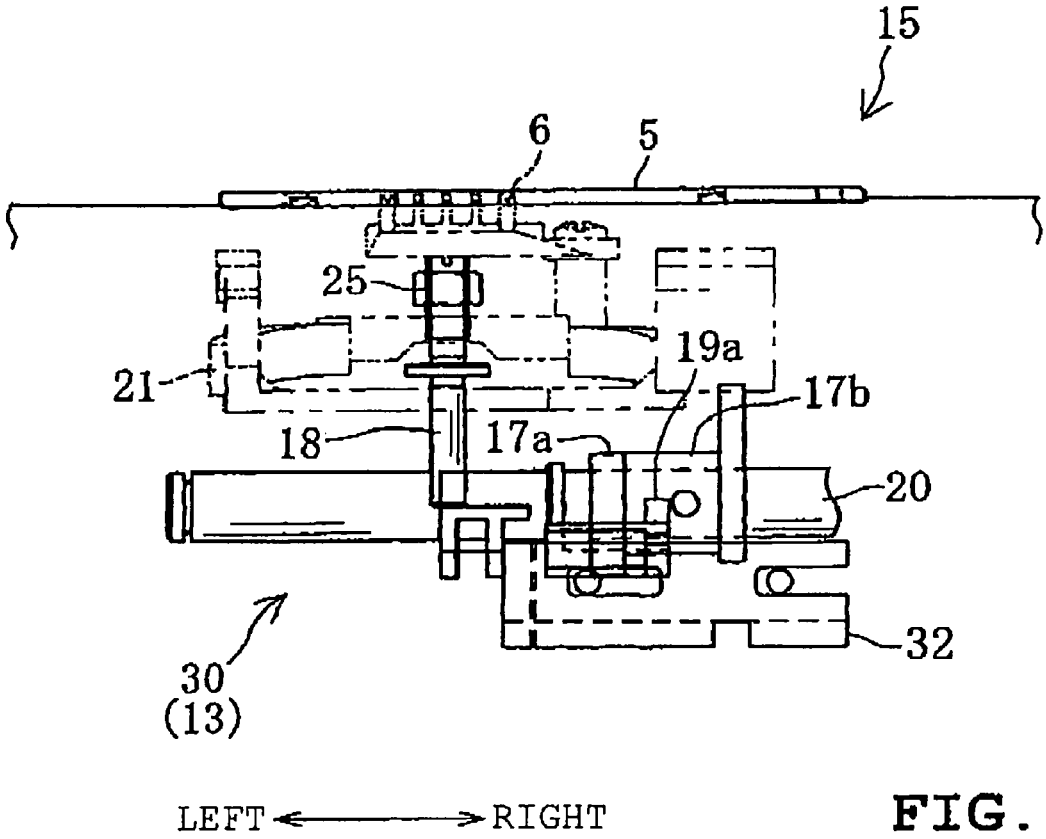
FIG. 5 is a front view (lowered state) of the feed dog vertically moving mechanism and the feed dog switching mechanism.

Referring to FIGS. 2 and 3, the feed dog vertically moving mechanism 15 includes a vertical feed cam 17 incorporated in the feed unit frame 16 (refer to FIG. 6), a vertically moving pin 18, and a vertical feed contact 19. Disposed inside the bed 1 is a laterally oriented lower shaft 20 connected conjunctively with the sewing machine main shaft, the lower shaft 20 having the vertical feed cam 17 integrally formed by an eccentric cam 17*a* and a concentric cam 17*b* secured thereto. The radius of the concentric cam 17*b* cam surface is equivalent to the minimum radius of the eccentric cam 17*a* cam surface.

The feed dog 6 is secured to the rear end of a feed base 21 upper surface and is capable of being moved between a cloth feed position (refer to FIG. 2) projecting above a needle plate 5 from square holes defined in the needle plate 5, and a lowered position (refer to FIG. 3) lowered below the needle plate 5.

Figure 6:
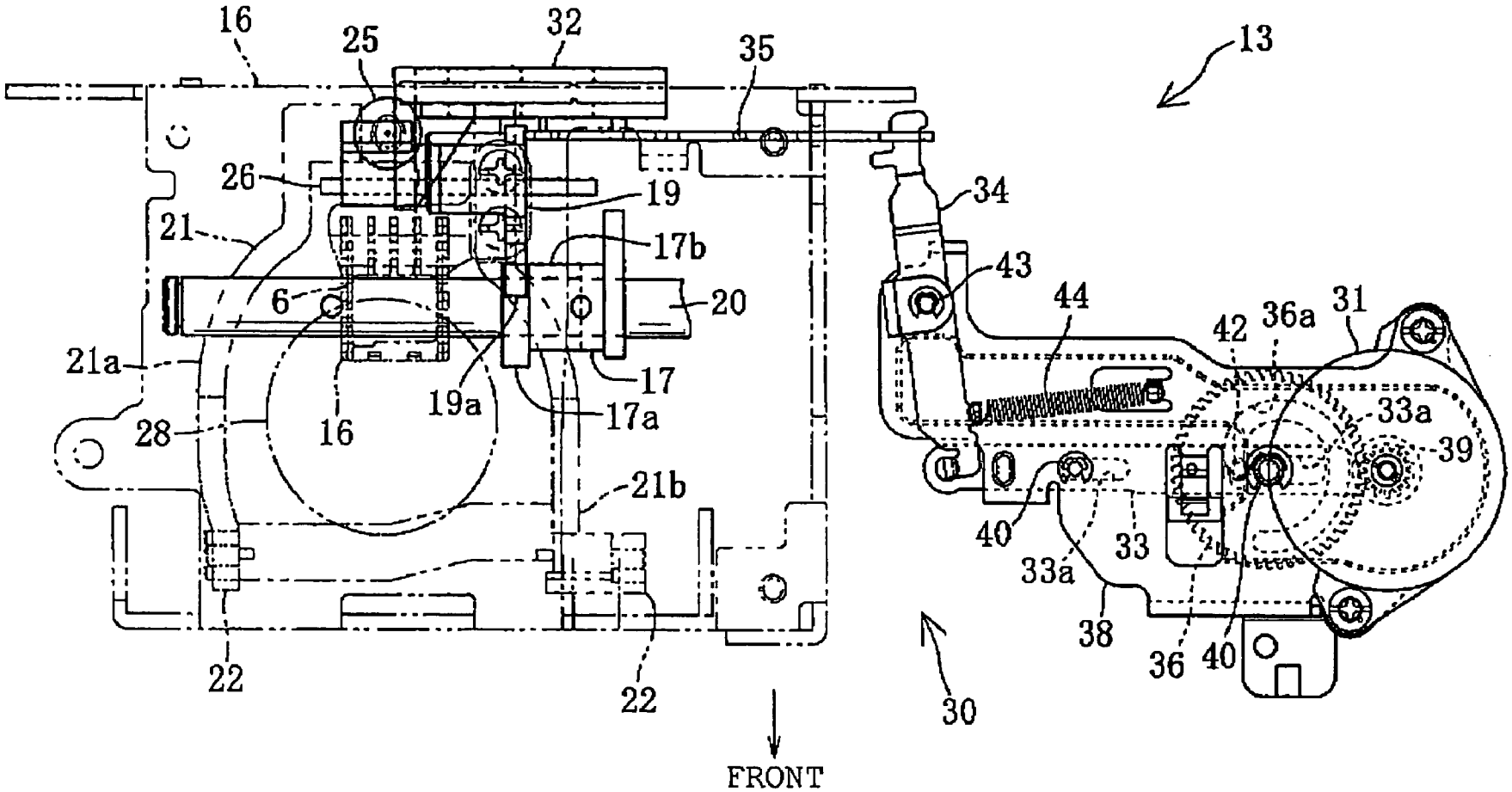
FIG. 6 is a plan view (cloth feed state) of the feed dog vertically moving mechanism and the feed dog activating switch unit.
Figure 7:
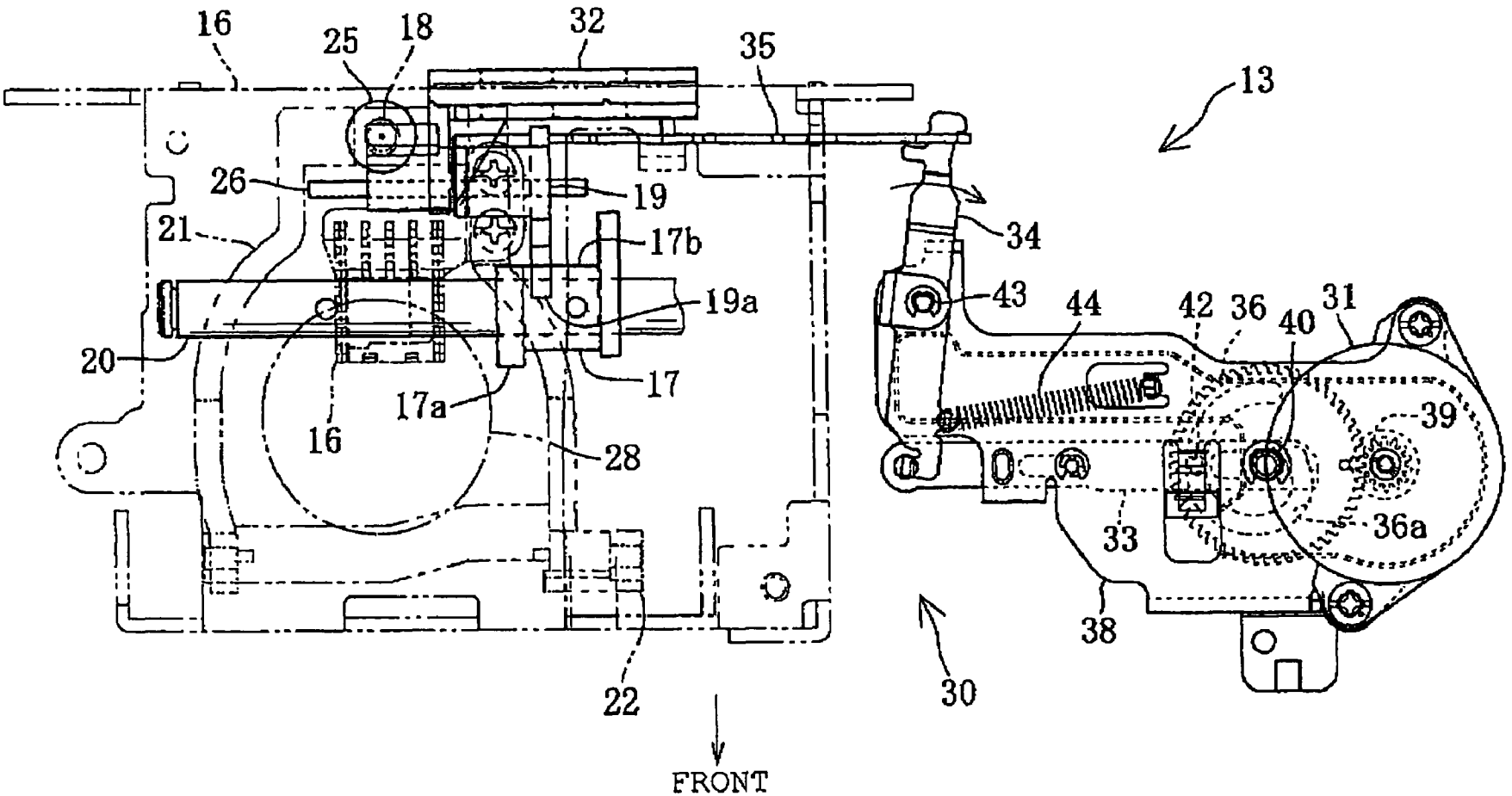
FIG. 7 is a plan view (lowered state) of the feed dog vertically moving mechanism and the feed dog activating switch unit.

As can be seen in FIGS.6 and 7, the front-end side of the feed base 21 is defined as an opening composed of legs 21*a* and 21*b* exhibiting a bifurcated profile, which front ends of the legs 21*a* and 21*b* are pivoted rotatably to the corresponding upper ends of a pair of left and right longitudinal swing levers 22 by pivot pins 23. The longitudinal swing levers 22 are pivoted swingably to the frame not shown by pivot pins 24 at the lower end thereof and are driven to swing longitudinally by a feed dog longitudinally moving mechanism via a longitudinal feed cam not shown composed of an eccentric cam secured to the lower shaft 20.

A height adjustment bolt 25 is provided at the rear end of the feed base 21, and the lower end of the height adjustment bolt 25 is placed in abutment with the upper end of a vertically-oriented vertical-movement pin 18. A vertical feed contact 19 is supported by a cam shaft 26 disposed behind and parallel to the lower shaft 20 so as to be slidable in the lateral direction in front view. The cam contact 19*a* formed in the distal end of the vertical feed contact 19 selectively contacts the eccentric cam 17*a* and the concentric cam 17*b*. The vertical feed contact 19 is biased leftward in front view by a compression coil spring not shown so as to render the cam contact 19*a* in contact the eccentric cam 17*a*.

Since the rear end of the feed base 21 is subject to consistent downward bias by an extension spring not shown, the abutment of the height adjustment bolt 25 lower end and the vertically moving pin 18 upper end are retained. Furthermore, abutment between the vertically moving pin 18 lower end and an upwardly oriented abutment portion 19*b* formed in the vertical feed contact 19 rear end; and contact between the cam contact 19*a* and the eccentric cam 17*a* are retained respectively.

Thus, when the lower shaft 20 is rotationally driven in a predetermined direction with the cam contact 19*a* contacting the eccentric cam 17*a*, the rotation of the eccentric cam 17*a* vertically swings the cam contact 19*a*. Thus, the vertically moving pin 18 is vertically moved via the vertical feed contact 19 and the rear end of the feed base 21 is moved in synchronization therewith, thereby vertically moving the feed dog 6 between a cloth feed position shown in FIG. 2 and a lowered position shown in FIG. 3.

Next, a description will be given on a feed dog activating switch unit 13 switching the feed dog 6 between an active state being vertically driven by the feed dog vertically moving mechanism 15, and an inactive state being positioned in a lowered position where the upper surface of the feed dog 6 is lowered below the upper surface of the needle plate 5. Since the feed dog activating switch unit 13 is well known, only a brief explanation will be given. The feed dog activating switch unit 13 includes a feed dog switch mechanism 30 switching the feed dog 6 between the active state and the inactive state, and a feed dog lowering motor 31 driving the feed dog switch mechanism 30.

As shown in FIGS. 4 to 8, the feed dog switch mechanism 30 includes a contact moving member 32 capable of laterally moving the vertical feed contact 19 of the aforementioned feed dog vertically moving mechanism 15; a first slide lever 33 and a second slide lever 35 laterally moving the contact moving member 32; a swing lever 34; and a follower gear 36 having a helical groove cam 36*a*. As shown in FIGS. 6 and 7, the contact moving member 32 is fitted to a part of a plate portion of a feed unit frame 16 from above, and is laterally movable by the guidance of the plate portion.

Figure 8:
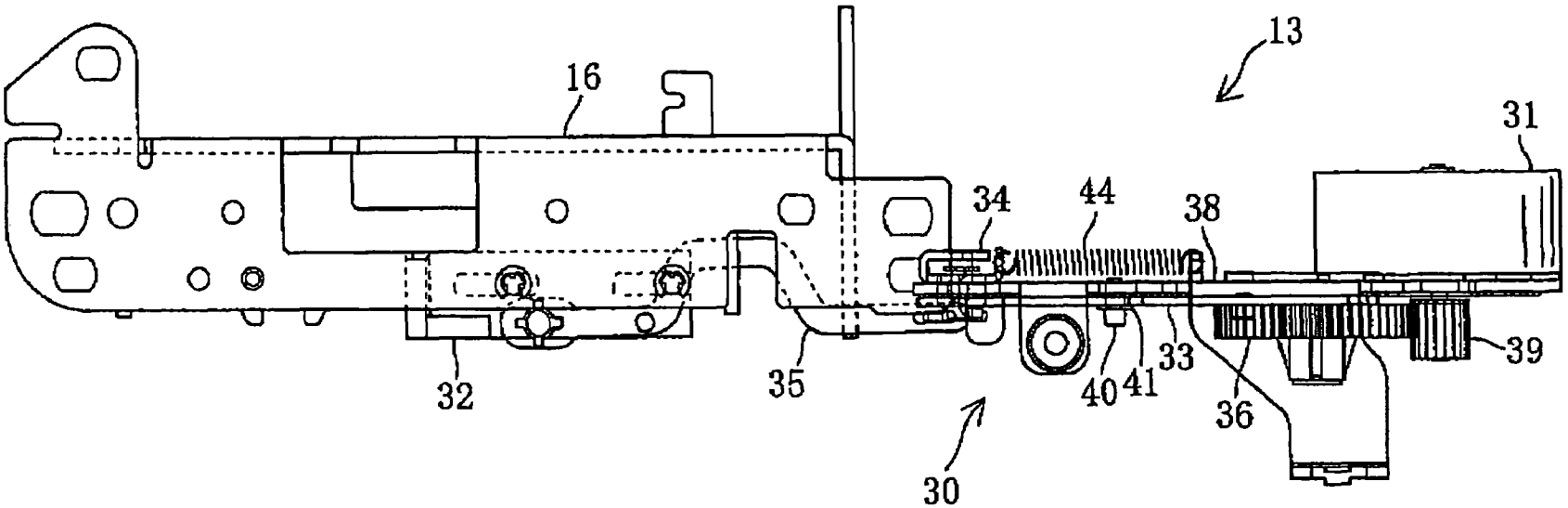
FIG. 8 is a front view of the feed dog vertically moving mechanism and the feed dog activating switch unit.

Referring to FIGS. 6 to 8, a drop unit frame 38 is provided to the immediate right side of the feed unit frame 16 and a feed dog lowering motor 31 is downwardly secured to the right end of the drop unit frame 38. The follower gear 36 placed in mesh engagement with a drive gear 39 secured to a drive shaft of the feed lowering motor 31, is rotatably supported by the underside of the drop unit frame 38. The helical groove cam 36*a* is defined on the upper surface of the follower gear 36 as shown in FIGS. 6 and 7.

Disposed on the underside of the drop unit frame 38 is a laterally extending first slide lever 33. The first slide lever 33 is rendered laterally slidable by inserting a pair of left and right first support pins 40 having upper ends thereof secured to the drop unit frame 38 respectively to a pair of left and right elongate holes 33*a* defined in the first slide lever 33 and mounting stop rings 41 in the lower side of the first support pins 40. Further, the first slide lever 33 has secured thereto an engagement pin 42 engaging with the helical groove cam 36*a* from above.

On the other hand, a swing lever 34 at its lengthwise mid-portion is supported swingably by the left end of the drop unit frame 38 by a second support pin 43. The front end of the swing lever 34 has connected thereto the left end of the first slide lever 33. The right end of the second slide lever 35 connected to the contact moving member 32 is connected to the rear end of the swing lever 34. Of note is that an extension spring 44 is hooked across the front end proximity of the swing lever 34 and the drop unit frame 38. The extension spring 44 is a spring for preventing noise arising from fitting rattle of the connecting portions or engagement portions of the helical groove cam 36*a* and the engagement pin 42; the first slide lever 33, the swing lever 34, and the second slide lever 35; and the second slide lever 35 and the contact moving member 32.

When the feed dog lowering motor 31 is rotated counterclockwise (this rotational direction is defined as the reverse rotation), the follower gear 36 is rotated clockwise and the first slide lever 33 is moved rightward via the engagement pin 42 engaging with the helical groove cam 36*a*. As a result, the swing lever 34 is swung counterclockwise and the contact moving member 32 is moved leftward via the second slide lever 35, thereby moving the vertical feed contact 19 from the concentric cam 17*b* to the eccentric cam 17*a*.

On the other hand, when the feed dog lowering motor 31 is rotated clockwise (this rotational direction is defined as a normal rotation), the follower gear 36 is rotated counterclockwise and the first slide lever 33 is moved leftward via the engagement pin 42 engaging with the helical groove cam 36*a*. Thus, the swing lever 34 is swung clockwise and the contact moving member 32 is moved rightward via the second slide lever 35 and the vertical feed contact 19 is moved from the eccentric cam 17*a* to the concentric cam 17*b*, positioning the feed dog 6 in the lowered position and making the switch to the inactive state.

Next, a description will be given on a thread cutting mechanism 14 provided in the left end of the bed 2.

Referring to FIGS. 9 to 15, the thread cutting mechanism 14 is provided as a unit by the base upper plate 50 and the base lower plate 51 and is disposed to the immediate left side of the horizontal rotary shuttle 28.

Figure 9:
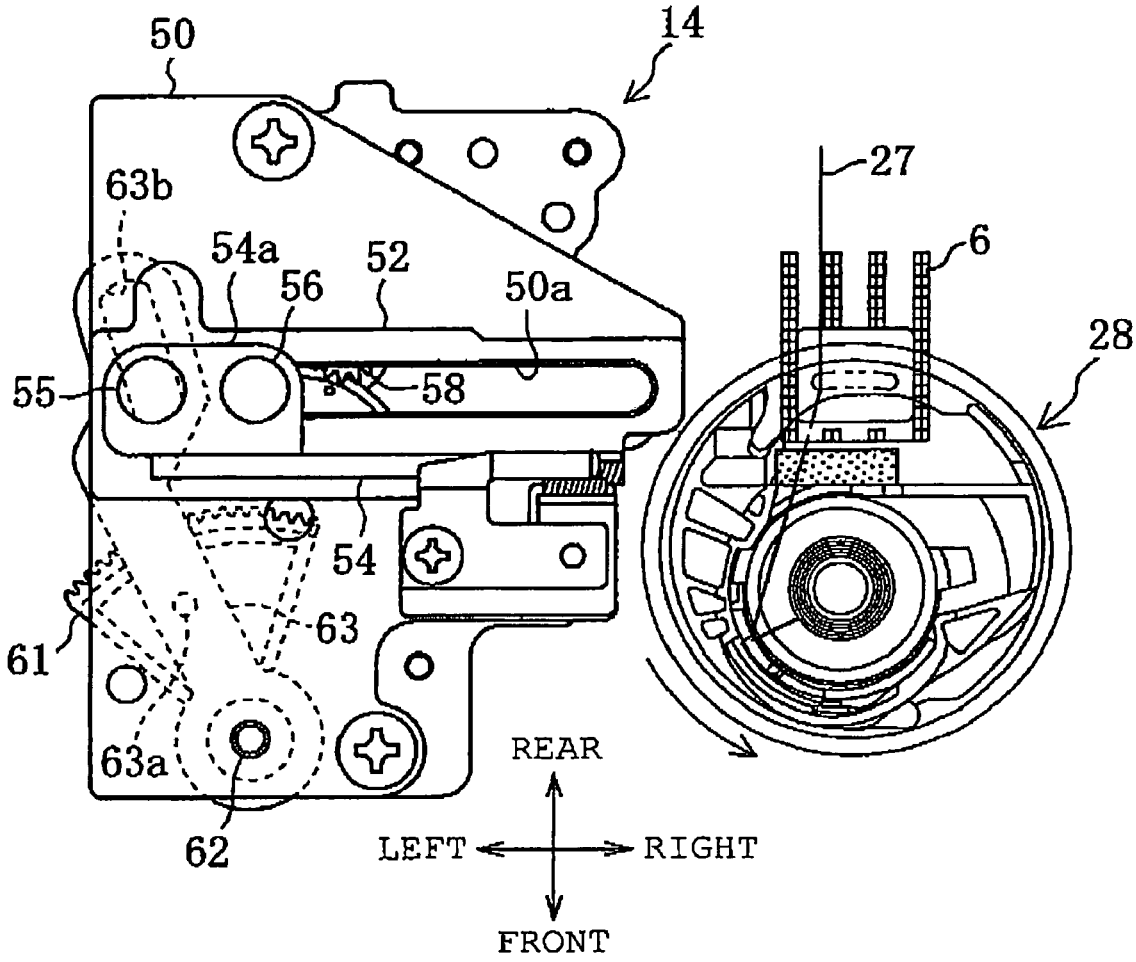
FIG. 9 is a plan view of the thread cutting mechanism.
Figure 10:
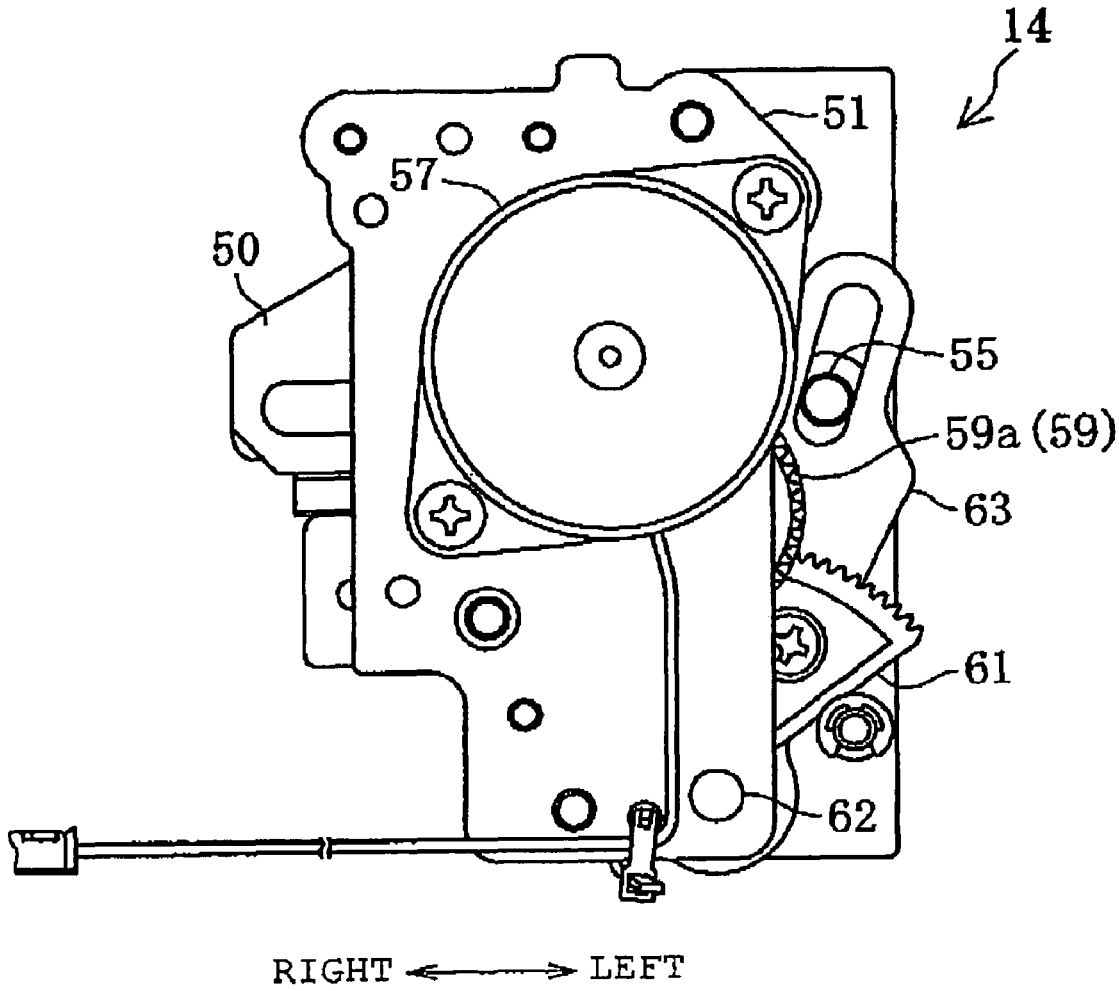
FIG. 10 is a bottom view of the thread cutting mechanism.

As shown in FIG. 9, the base upper plate 50 has a laterally oriented elongate through-hole 50*a* defined thereto and secured at a plurality of locations around the elongate through-hole 50*a* of the upper surface of the base upper plate 50 is a guide member 52 made of resin in thin plate form. Also, the right end of the front side of the guide member 52 has secured thereto a lower end of a laterally disposed cutting blade 53 to cut the needle thread (not shown) and the bobbin thread 27 in cooperation with the thread taker 54. The blade of the cutting blade 53 constitutes the right side end.

The thread taker 54 (refer to FIGS. 13 and 14) is laterally disposed on the upper side of the guide member 52 and two downwardly oriented guide pins 55 and 56 are provided in a horizontal drive portion 54*a* formed at the base end of the thread taker 54. The two guide pins 55 and 56 are movably fitted with the elongate through-hole 50*a* of the base upper plate 50.

Figure 14:
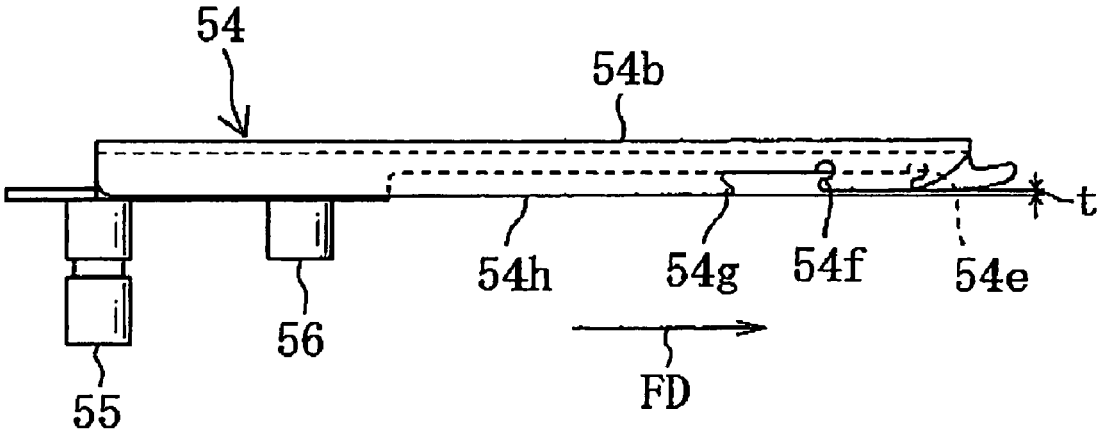
FIG. 14 is a front view of the thread taker.

As shown in FIG. 14, formed on the distal end of the taker body 54*b* taking a linear profile and a U-shape cross section, of the thread taker 54 is a first thread taker 54*e* catching the needle thread and the bobbin thread 27 in the cloth side, and the second thread taker 54*f* catching the needle thread in the needle side and the bobbin thread in the bobbin side respectively. That is, the first thread taker 54*e* is formed in the distal end of a rear vertical wall 54*c* of the taker body 54*b*. The second thread taker 54*f* is formed in the distal end of the front vertical wall 54*d* of the taker body 54*b*, more specifically, in the downstream relative to an advancing movement direction FD of the thread taker 54 and distanced by a predetermined dimension from the first thread taker 54*e*.

Figure 11:
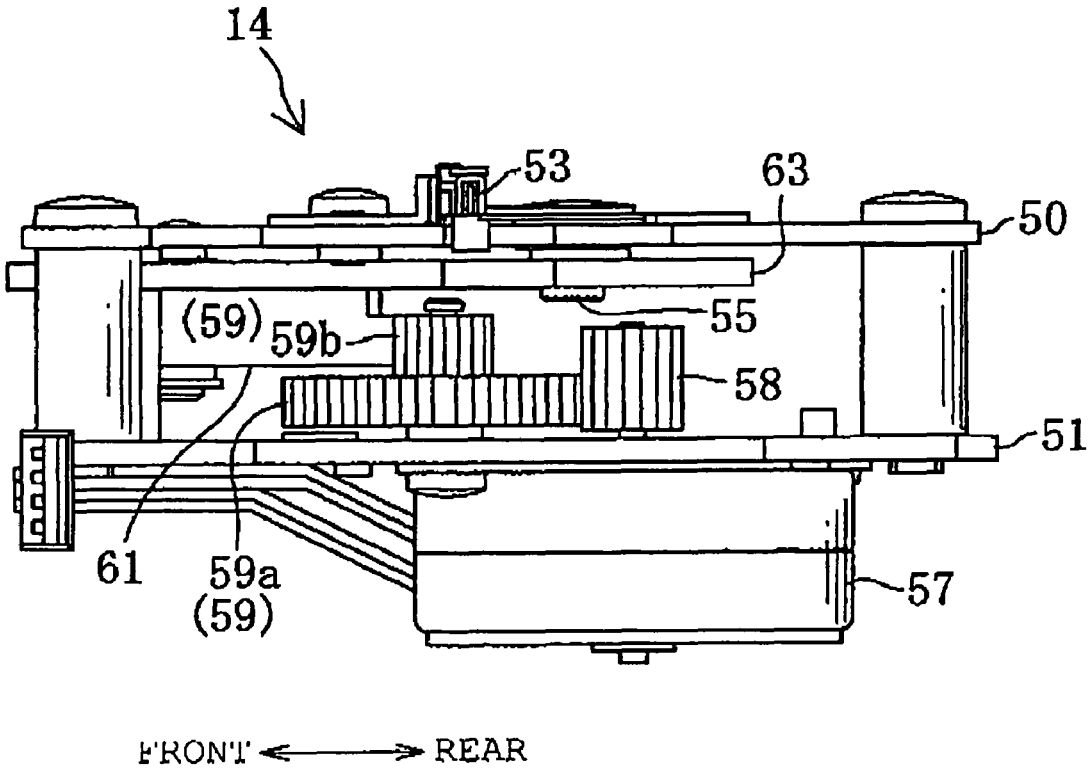
FIG. 11 is a right side view of the thread cutting mechanism.
Figure 12:
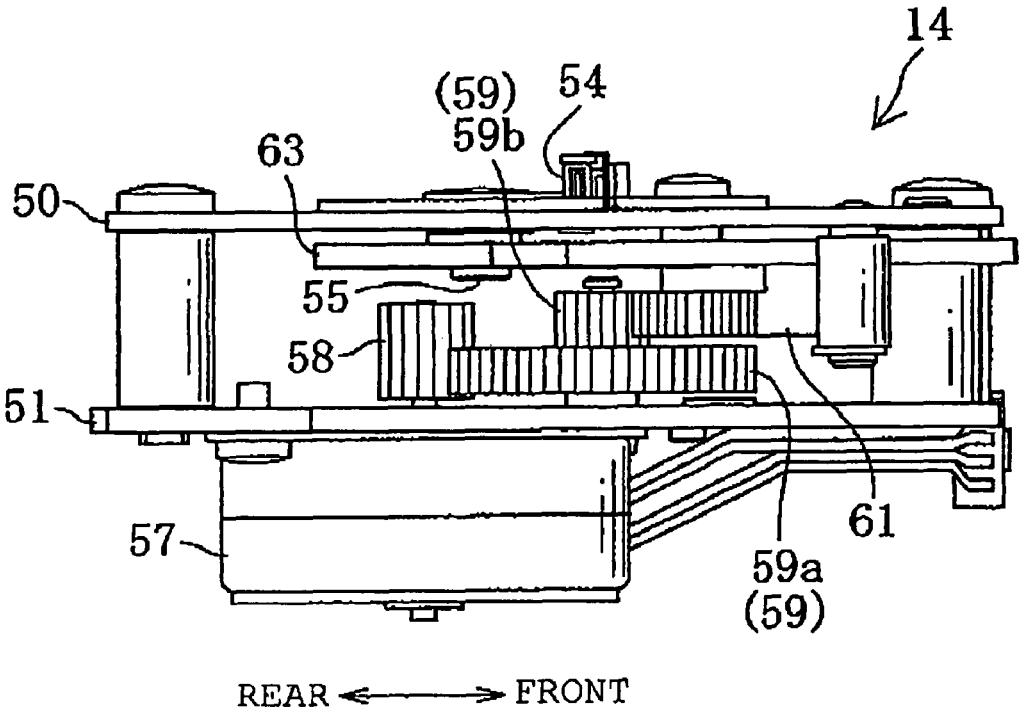
FIG. 12 is a left side view of the thread cutting mechanism.
Figure 13:
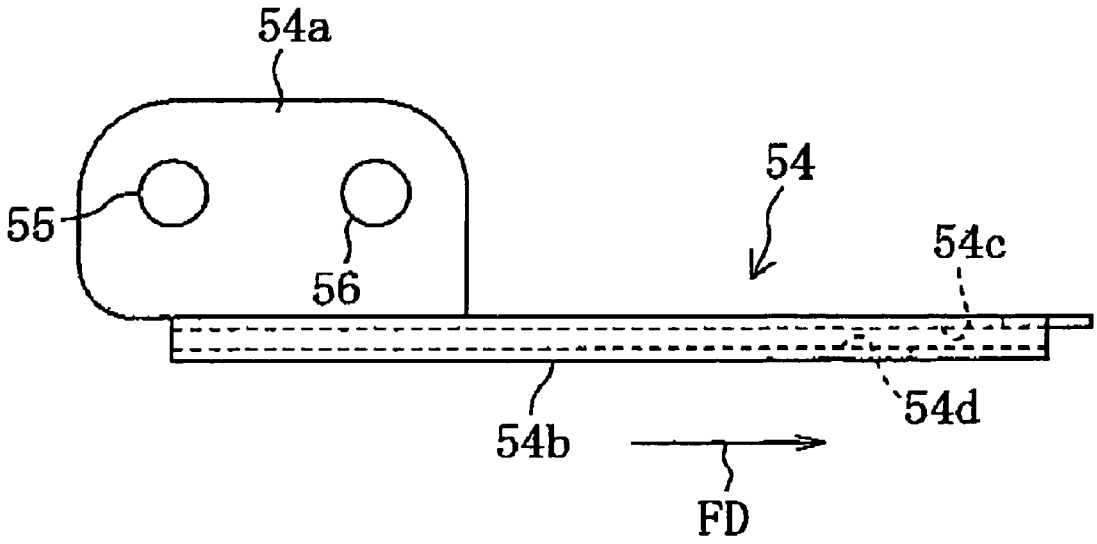
FIG. 13 is a plan view of a thread taker.

The aforementioned taker body 54*b* having U-shaped cross section is disposed in a position to covers the cutting blade 53 secured to the guide member 52 as shown in FIGS. 11 and 12. The thread taker 54 laterally reciprocates along the elongate through-hole 50*a* of the base upper plate 50 so that the inner side of the taker body 54*b* does not contact the cutting blade 53.

Thus, when the thread taker 54 reciprocates, the bobbin thread 27 and the needle thread are caught by the first thread taker 54*e* and the second thread taker 54*f* and thereafter cut by the cutting blade 53. The first thread taker 54*e* has formed at its distal end in the advancing movement direction FD, a projecting sloped end that assists the thread taker 54 in moving over the lower thread 27 upon movement in the advancing direction.

As shown in FIG. 14, a thread hooking portion 54*g* is formed integrally with the thread taker 54, more specifically, the thread hooking portion 54*g* is spaced by a predetermined distance downstream of the advancing movement direction FD of the thread taker 54 from the second thread taker 54*f* of the front vertical wall 54*d*. Furthermore, a thread sliding portion 54*h* is defined in a continuous profile from the thread hooking portion 54*g* to the base end of the taker body 54*b*. Moreover, the lower end of the thread hooking portion 54*g* is formed lower than the lower end of the second thread taker 54*f* by a predetermined dimension t and also the lower end portion of the thread hooking portion 54*g* directed toward the second thread taker 54*f* defines an acute angle. The thread hooking portion 54*g* is formed to hook the bobbin thread 27 in advance upon advancing movement of the thread taker 54 so that the second thread taker 54*f* can reliably catch the bobbin thread 27 upon returning movement of the thread taker 54.

Referring to FIGS. 11 and 12, the thread cutting motor 57 is secured to the underside of the base lower plate 51 by a screw and a drive gear 58 secured to the drive shaft of the thread cutting motor 57 is positioned above the base lower plate 51. A large-diameter gear 59*a* of a transmitting gear 59 made of resin is placed in mesh engagement with the drive gear 58.

On the other hand, referring to FIGS. 9, 10, 11 and 12, a sector gear 61 disposed below the base upper plate 50 is pivoted rotatably at a base end thereof by a vertically oriented support pin 62 secured to the base upper plate 50. The sector gear 61 and the small-diameter gear 59*b* formed integrally with the large-diameter 59*a* establish a mesh engagement.

The base end of the swing lever 63 is rotatably supported by the support pin 62 and the sector gear 61 and the swing lever 63 are integrally secured by a connection pin 63*a*. Thus, the sector gear 61 and the swing lever 63 are swung integrally by the rotation of the transmitting gear 59. An elongate hole 63*b* is defined in the distal end portion (rear end portion) of the swing lever 63, and the guide pin 55 in the left side of the thread taker 54 is fitted to the elongate bole 63*b*.

Figure 15:
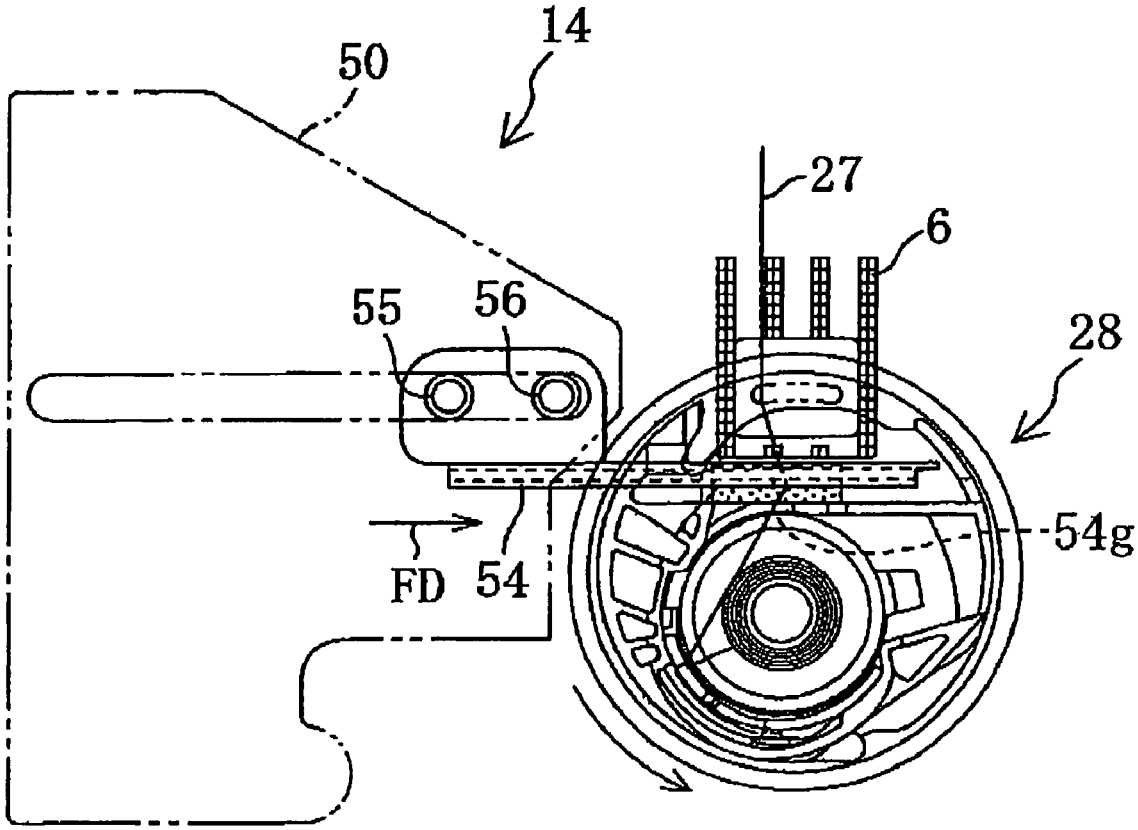
FIG. 15 corresponds to FIG.9 taking maximum advancing movement position.

When the thread cutting motor 57 is rotated clockwise in plan view, the thread taker 54 is moved in the advancing movement direction FD until reaching maximum advancing movement position indicated at FIG. 15 via the drive gear 58, the sector gear 61, and the swing lever 63 with the guidance of the elongate hole 63*b*. Conversely, when the thread cutting motor 57 is rotated counterclockwise, the thread taker 54 is moved in the returning movement direction RD (the opposite direction of the advancing movement direction FD) until reaching a stand-by position indicated at FIG. 9 with guidance of the elongate hole 63*b*.

Next, a description will be given on a control system of the sewing machine M.

Figure 16:
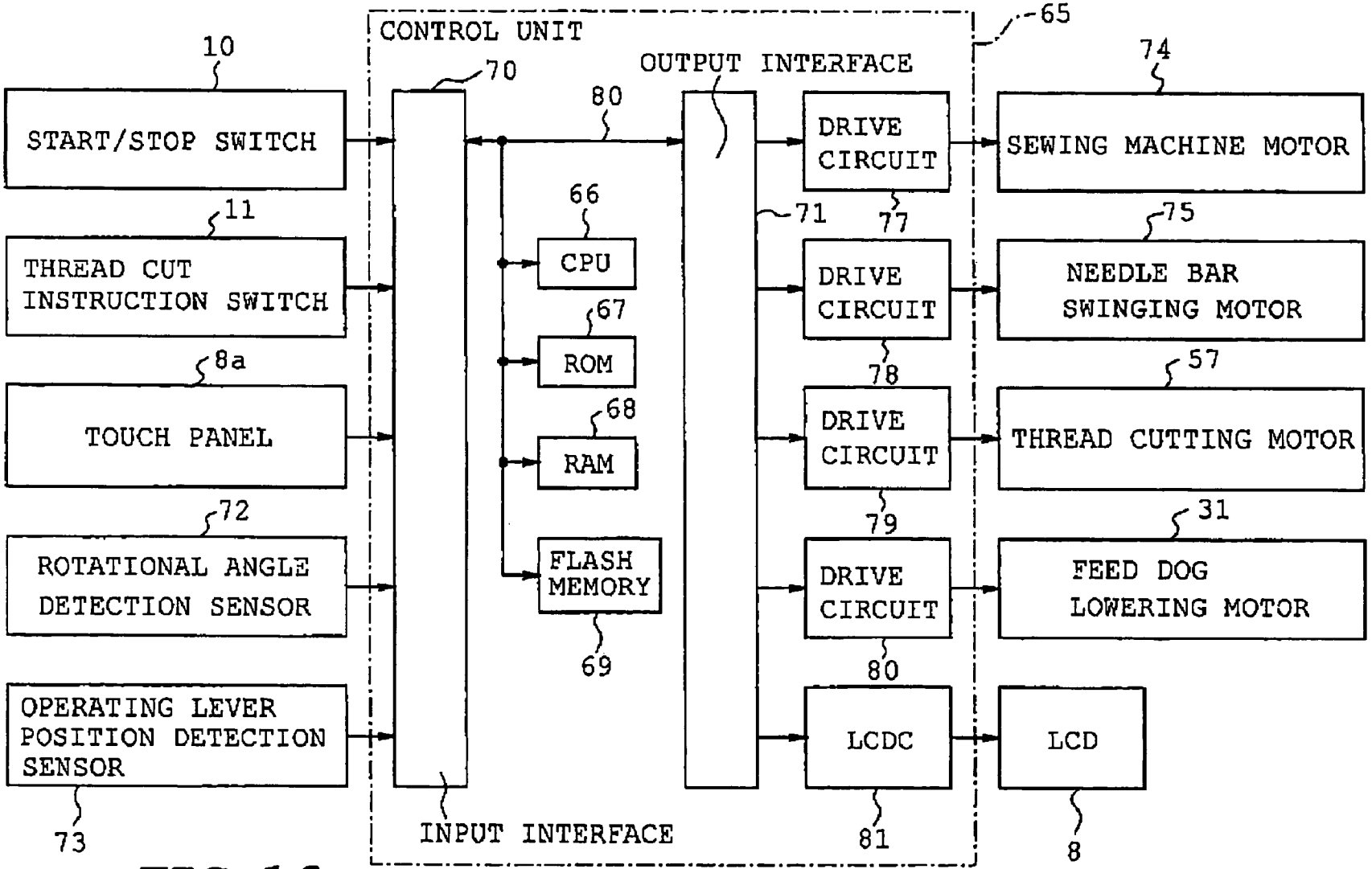
FIG. 16 is a block diagram of a control system of the electronically controlled zigzag sewing machine.

Referring to FIG. 16, a control unit 65 is configured by a microcomputer including a CPU 66, a ROM 67, a RAM 68 and a non-volatile electrically rewritable memory designated as flash memory 69; and input interface 70 and output interface 71 connected to the microcomputer by a bus 80 such as data bus. Furthermore, the control unit 65 includes drive circuits 77, 78, 79 and 80 for a sewing machine motor 74, a needle bar swing motor 75, a thread cutting motor 57, and a feed dog lowering motor 31 respectively; and a display controller (LCDC) 81 for the liquid crystal display (LCD) 8.

The input interface 70 receives input of detection signals from the start/stop switch 10, the thread cut instruction switch 11, the touch panel 8*a*, a rotational angle detection sensor 72 detecting the rotational position of the sewing machine main shaft, an operating lever position detection sensor 73, and the like. On the other hand, the output interface 21 outputs drive signals to drive circuits 77 to 80 for motors 31, 57, 74 and 75 respectively and for the display controller 81.

The ROM 67 has preinstalled thereto a sewing control program including drive controls for various drive mechanisms and various display controls; a display control program for displaying various display data to the liquid crystal display 8; and control programs for thread cutting control and feed dog lowering control constituting the feature of the present disclosure, and the like. The RAM 68 includes various work memory in addition to memory for storing various parameters required for sewing control. The flash memory 69 stores various parameters that need to be retained even when power supply is shut down.

Figure 17:
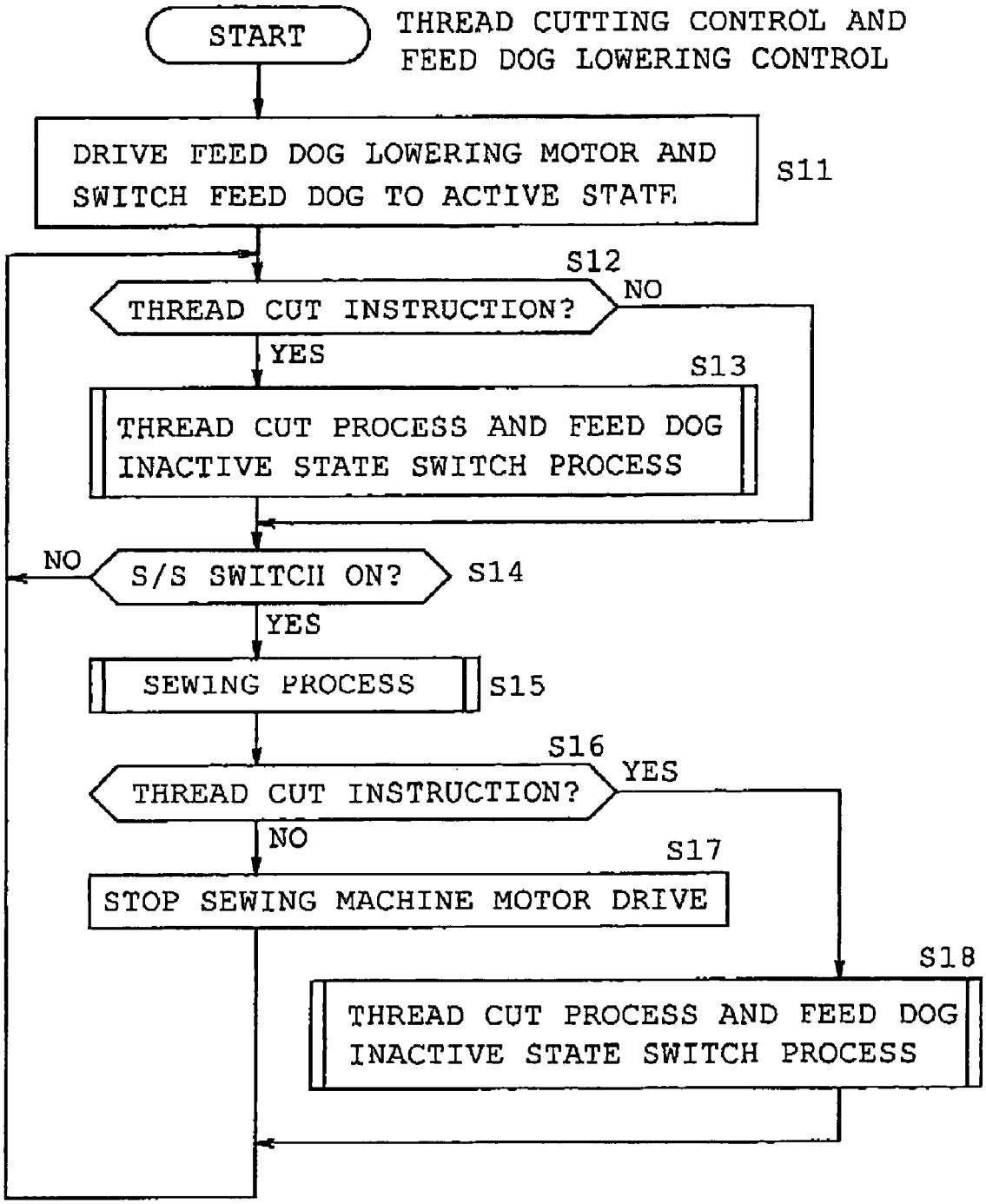
FIG. 17 is a flowchart of a thread cutting control and a feed dog lowering control.
Figure 18:
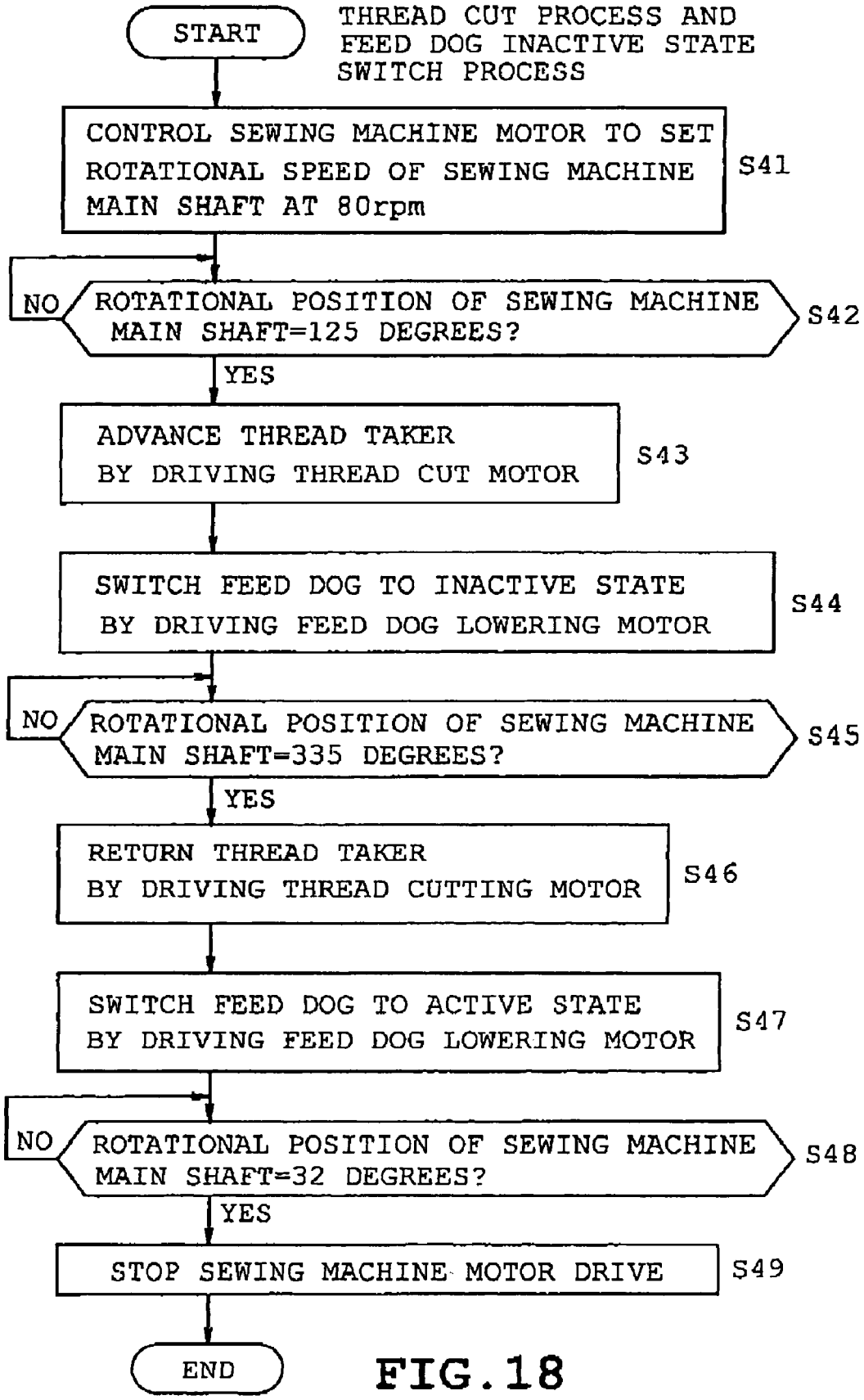
FIG. 18 is a flowchart of the thread cutting control and a feed dog inactive state switch process control.

Next, a description will be given on the thread cutting control and the feed dog lowering control executed by the control unit 65 and the operation of switching the feed dog to the inactive state with reference to the flow chart of FIGS. 17 and 18. Reference symbols Si (i=11, 12, 13 . . . ) indicated each step.

When power is supplied to the sewing machine M, first, the feed dog lowering motor 31 is normally rotated and the feed dog 6 is switched to the active state (S11). As described earlier, the contact moving member 32 is moved to the left and the vertical feed contact 19 is placed in a condition capable of abutting the eccentric cam 17*a*. When the sewing machine motor 74 is driven under such state, cloth feed is executed from the first stitch when the vertical feed contact 19 is already placed in a position to abut the eccentric cam 17*a*. Also, as will be described later, cloth feed is executed from the second stitch onwards when the vertical feed contact 19 is in abutment with the right side surface of the eccentric cam 17*a* and residing in the cam surface of the concentric cam 17*b*.

Subsequently, in case the thread cut instruction switch 11 has not been operated and therefore no thread cut instruction is issued (S12: No), if the start/stop switch 10 (S/S switch) is turned ON (S14: Yes), sewing process is executed (S15). In case the thread cut instruction switch 11 has been operated during the sewing operation of the sewing process, or in case "execute thread cut" has been instructed in advance at "thread cut setting" displayed on the liquid crystal display 8; that is, when thread cut instruction has been issued (S16: Yes), thread cut process and feed dog inactive state switch process (refer to FIG. 18) is executed (S18).

When this process control is started, first, the sewing machine motor 74 is driven so that rotational speed of the sewing machine main shaft is set at "80 rpm" (S41). That is, even in case the thread cut instruction switch 11 is operated during the sewing operation and in case the drive of the sewing machine motor 74 is stopped after termination of the sewing process, the drive of the sewing machine motor 74 is controlled. Then, the sewing machine main shaft is rotated until reaching the rotational position of 125 degrees based on the detection signal delivered from the rotational angle detection sensor 72 (S42: No).

When the rotational position of the sewing machine main shaft has reached 125 degrees, that is, when the feed dog 6 is lowered to the lowered position (lower position) and at the time of rendering the advancing movement of the thread taker 54 (S42: Yes), the thread cutting motor 57 is driven and the thread taker 54 is moved in the advancing direction (S43). Furthermore, the feed dog lowering motor 31 is driven in normal rotation, and the feed dog 6 is switched to the inactive state (S44).

At this point, when the contact moving member 32 is moved to the right, the vertical feed contact 19 is merely moved from the minimum radius cam surface of the eccentric cam 17*a* to the concentric cam 17*b* cam surface having equivalent radius, thereby reliably preventing occurrence of switching noise upon switching the feed dog 6 to the inactive state. Moreover, at this point, as described earlier, the bobbin thread 27 is reliably hooked by the acute distal end of the thread hooking portion 54*g*. Then, the sewing machine main shaft is rotated until reaching the rotational position of 335 degrees, based on the detection signal delivered from the rotational angle detection sensor 72 (S45: No).

When the rotational position of the sewing machine main shaft has reached 335 degrees (S45: Yes), the thread cutting motor 57 is driven to move the thread taker 54 in the returning movement direction (S46). Furthermore, the feed dog lowering motor 31 is driven in reverse rotation, thereby switching the feed dog 6 in the active state (S47) as described earlier.

However, at this point, even if the contact moving member 32 is moved leftward, since the vertical feed contact 19 is still in abutment with the right side surface of the eccentric cam 17*a*, that is, still in contact with the concentric cam 17*b* cam surface, the feed dog 6 is situated in the lowered position. On the other hand, the thread cutting mechanism 14, as described earlier, returns to the stand-by position with both the bobbin thread 27 and the needle thread caught by the second taker 54*f* and the first taker 54*e*. However, during the process of the returning movement, the needle thread between the first taker 54*e* and the second taker 54*f* and the needle thread intersect so as to contact the cutting blade 53 and thereafter cut the bobbin thread 27 and the needle thread at the same time by the cutting blade 53.

Next, the sewing machine main shaft is rotated until reaching the rotational position of 32 degrees (S48: No), and when the sewing machine main shaft reaches the rotational position of 32 degrees (S48: Yes), the drive of the sewing machine motor 74 is stopped (S49), the process control is terminated.

In the thread cutting control and the feed dog lowering control, when a sewing process is executed (S15) and in case the thread cut instruction has not been inputted (S16: No), the drive of the sewing machine motor 74 is stopped after terminating the sewing process (S17). At this time (in the final phase of the sewing process), when the user operates the thread cut instruction switch 11, and the thread cut instruction is issued (S16: Yes), the thread cutting process and the feed dog inactive state switch process are executed immediately (S18).

Thus, when the thread cut instruction switch 11 is operated, the thread cutting mechanism 14 is driven based on the thread cut instruction and the feed dog activating switch unit 13 is controlled so as to switch the feed dog 6 to the inactive state positioned in the lowered position. Thus, instead of frequently switching the feed dog 6 to the lowered position upon every instance of switching the presser foot lifting lever to the lifted position, the feed dog 6 is arranged to be moved to the lowered position after cutting the needle thread and the bobbin thread 27 by the thread cutting mechanism 14 at the time of placing/removing the workpiece cloth. Therefore, the workpiece cloth can be moved smoothly without being caught on the feed dog.

Also, it is arranged so that the vertical position of the feed dog 6 in the active state is detected by the rotational angle detection sensor 72. The output of the rotational angle detection sensor 72 provides a basis for controlling the switching of the feed dog vertically moving mechanism 15 to the inactive state when the feed dog 6 is in the lowered position. Thus, when the feed dog 6 is switched from the active state, in which the feed dog 6 is vertically driven, to the inactive state, in which the feed dog 6 is positioned in the lowered position, the feed dog 6 is already placed in the lowered position allowing the cam contact 19*a* of the vertical feed contact 19 to be moved smoothly from the eccentric cam 17*a* to the concentric cam 17*b*. This eliminates the occurrence of an annoying switching noise when the switching takes place.

Furthermore, by providing a rotational detection sensor 72 that detects the rotational angle of the sewing machine main shaft and driving the feed dog vertically moving mechanism 15 in synchronization with the rotation of the sewing machine main shaft, the vertical position of the feed dog 6 is detected by the detection signal delivered from the rotational angle detection sensor 72. Thus, the timing in which the feed dog 6 is lowered to the lowering position (lower position) can be detected accurately, thereby reliably eliminating the occurrence of switching noise when the feed dog 6 is switched to the inactive state.

Next, partial modifications of the above explained embodiment will be described hereinafter.

(1) The aforementioned thread cutting control and the feed dog lowering control are partially modified so that the decision whether to execute the feed lowering control or not is set in advance. In case of executing the feed dog lowering control, the feed dog 6 maybe switched to the inactive state when the operating lever is switched from the lowered position to the lifted position after the thread cutting process and the feed dog 6 may be switched to the active state when the operating lever is switched from the lifted position to the lowered position. This control is explained in more detail hereinafter.

First, the user is to select whether to execute control for the feed dog activating switch unit 13 in the "execution mode/non-execution mode setting screen" displayed to the liquid crystal display 8 by selecting either of the execution mode or the non-execution mode.

Figure 19:
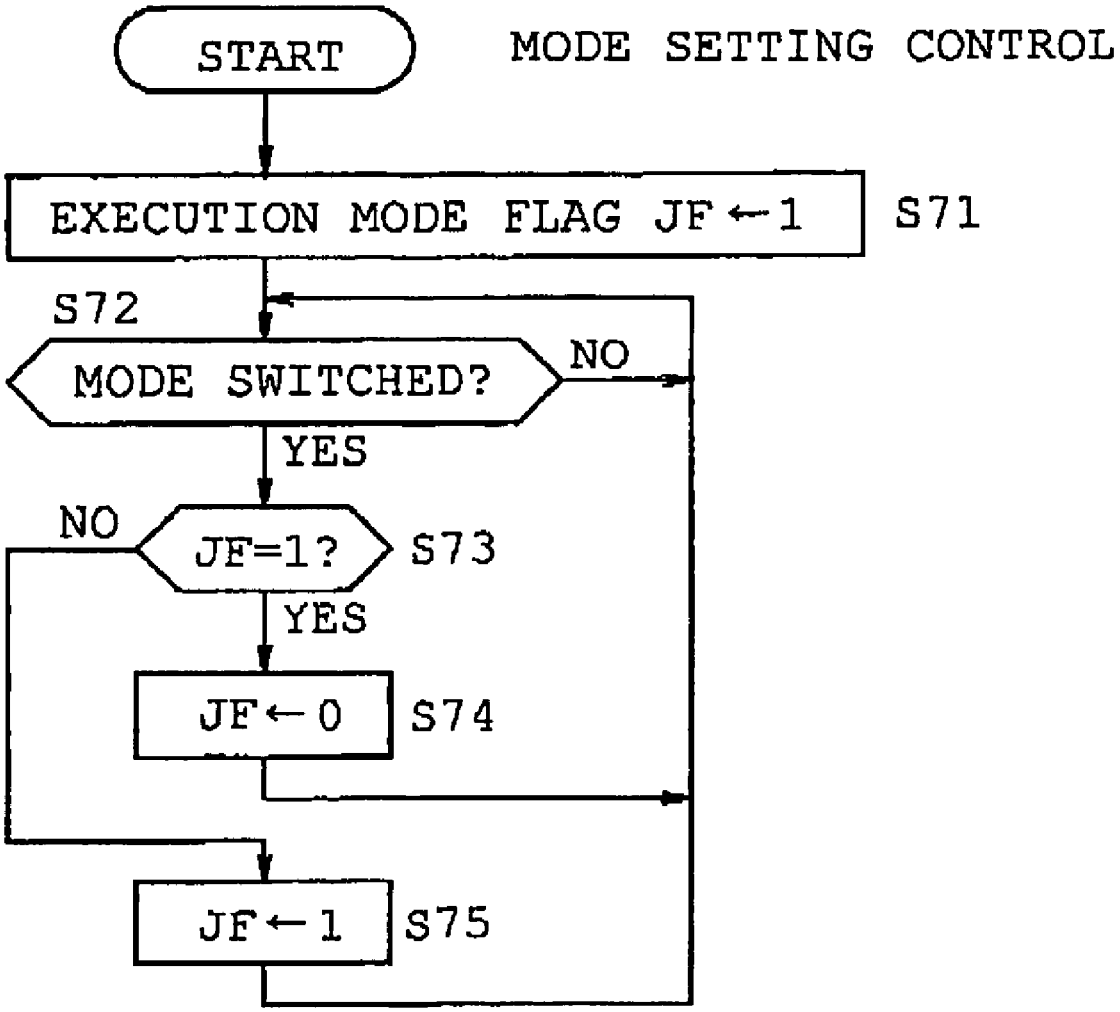
FIG. 19 is a flowchart of a mode setting control.

More specifically, when power is supplied in the mode setting control indicated at FIG. 19, "1" is set to an execution mode flag JF by default and execution mode is set (S71). In this case, "set" is displayed to the "execution mode/non-execution mode setting screen". Thereafter, in case the user does not switch the mode (S72: No), S72 is repeated.

However, in case the user has switched the mode (S72: Yes) and the execution mode flag JF is currently set (flag data=1), that is, in case the execution mode is set (S73: Yes), the execution mode flag JF is reset (flag data=0) and non-execution mode is set (S74). On the other hand, in case the execution mode flag JF is reset (flag data=0), that is, in case the non-execution mode is set (S73: No), the execution mode flag JF is set (flag data=1), and the execution mode is set (S75).

Figure 20:
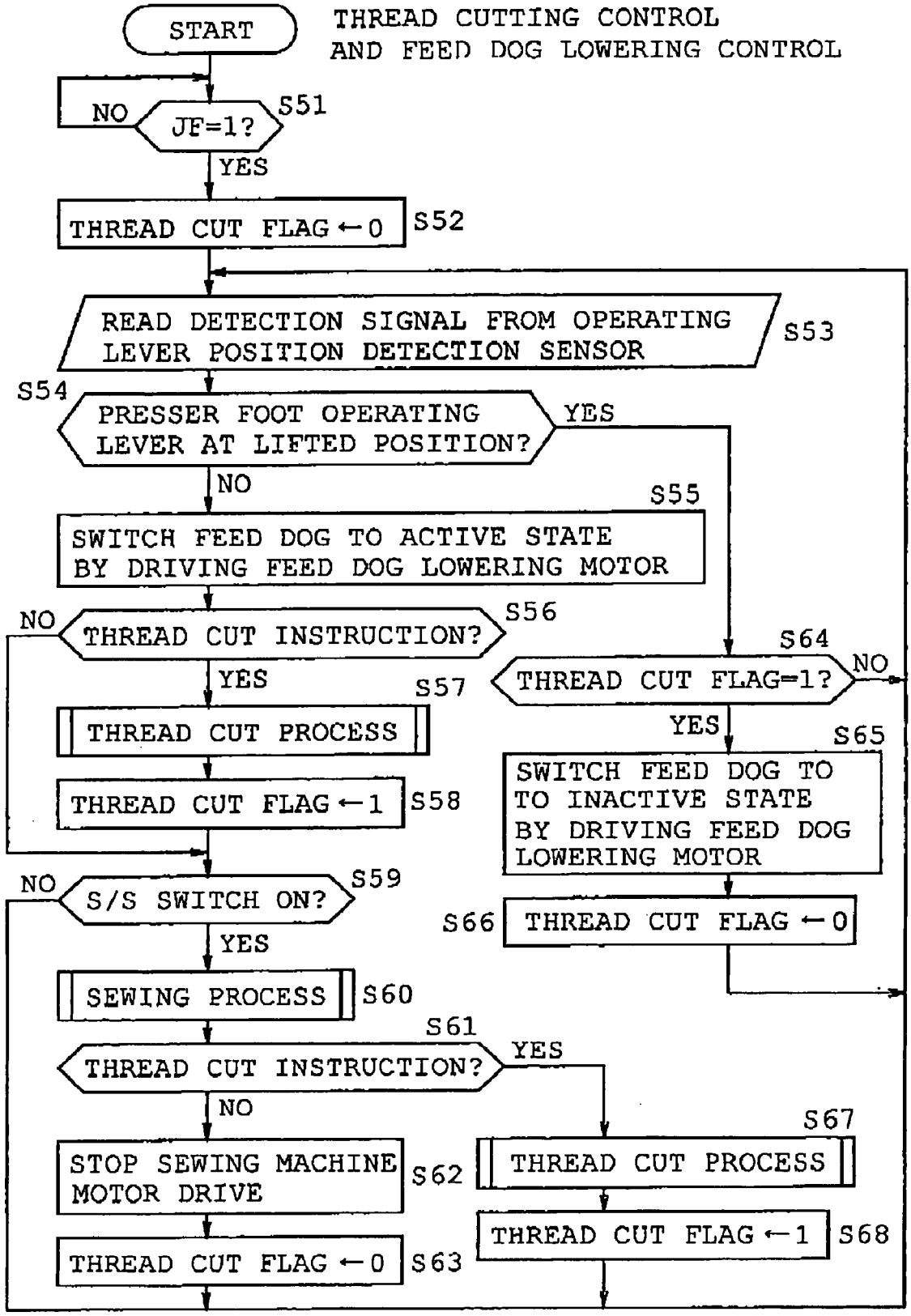
FIG. 20 is a flowchart of the thread cutting control and the feed dog lowering control in accordance with a modified illustrative aspect.

Next, the thread cutting control and the feed dog lowering control will be described based on FIG. 20.

When this control is started, in case the flag data of the execution mode flag JF is "0" and the non-execution mode is set (S51: No), S51 is repeated. That is, the thread cutting control and the feed dog lowering control will not be executed.

However, in case the flag data of the execution mode flag JF is "1", and the execution mode is set (S51: Yes), a thread cutting flag for issuing the thread cut instruction is reset (flag data=0) (S52). Next, even if the detection signal delivered from the operating lever position detection sensor 73 has been read (S53), power has just been supplied, and the presser foot operating lever has been switched to the lifted position (S54: Yes); in case the thread cutting flag is reset, (S64: No), S53 and beyond are repeated.

Next, after placing the workpiece cloth to be sewn on the needle plate 5, in case the presser foot operating lever is switched from the lifted position to the lowered position (S54; No), the feed dog lowering motor 31 is rotated clockwise and the feed dog 6 is switched to the active position (S55) as described earlier. Subsequently, in case start/stop switch 10 is operated (S59: Yes) with no thread cut instruction issued (S56: No), a sewing process is executed (S60).

In case the thread cut instruction switch 11 has been operated during a sewing process, or "execute thread cut" has been instructed in advance at "thread cut setting" displayed on the liquid crystal display 8 upon sewing start, in other words, in case the thread cut instruction has been issued (S61: Yes), the thread cutting process is executed (S67) as described earlier and the thread cut flag is set (S68).

Subsequently, in S54 following S53, in case the presser foot operating lever is switched to the lifted position (S54: Yes), the feed dog lowering motor 31 is driven in normal rotation since the thread cut flag is set (S64: Yes) and the feed dog 6 is switched to the inactive state (S65) whereafter the thread cut flag is reset (S66) as described earlier.

After the sewing process is executed at S60, in case the thread cut instruction is not inputted (561; No), the drive of the sewing machine motor 74 is stopped (562), the thread cut flag is reset (S63). At this time, since the presser foot operating lever is situated in the lowered position (S54: No), the feed dog lowering motor 31 is driven in reverse rotation and the feed dog 6 is switched to the active state (S55). However, at this point, the vertical feed contact 19 maintains contact with the eccentric cam 17*a*.

Subsequently, in case the thread cut instruction switch 11 is operated, and the thread cut instruction is issued (S56: Yes), the thread cutting process is executed (557) immediately and the thread cut flag is set (S58). At this time, if the start/stop switch 10 is not operated (S59: No), and the presser foot operating lever is switched to the lifted position (S54: Yes), since the thread cut flag is set (S64: Yes) as described earlier, the feed dog 6 is switched to the inactive state (S65), and the thread cut flag is reset (S66).

Thus, by providing a presser foot operating lever that switches the presser bar supporting the presser foot between the lowered position and the lifted position, and an operating lever position detection sensor 73 that detects the vertical position of the presser foot operating lever, and when the presser foot operating lever is switched from the lifted position to the lowered position based on the detection signal delivered from the operating lever position detection sensor 73, the control unit 65 controls the feed dog activating switch unit 13 to switch the feed dog vertically moving mechanism 15 to the active state. Thus, since the feed dog 6 is automatically switched to the active state by merely switching the presser foot operating lever from the lifted position to the lowered position upon sewing start, the sewer need not perform any complex operations of switching the feed dog 6 to the active state and smoothly proceed with the next sewing operation. Such configuration simplifies user operation and reliably prevents occurrence of sewing stoppage caused by the workpiece not being fed because of the feed dog placed in the lowered position.

Also, since the feed dog activating switch unit 13 includes a feed dog switch unit 15 that switches the feed dog 6 between the active state and the inactive state; and a feed dog lowering motor 31 for driving the feed dog switch mechanism 15; the feed dog switch mechanism 15, being separate from the feed dog lowering motor 31 can be positioned with higher flexibility in layout. The feed dog switch mechanism 15 may be driven by a cylinder that uses compressed air or oil pressure instead of the feed dog lowering motor 31.

Furthermore, since the mode setting control is configured to make the switch between the execution mode and the non-execution mode to determine whether or not to execute control of the feed dog activating switch unit 13 by the control unit 65. Thus, the user is allowed to choose whether or not to switch the feed dog 6 to the lowered position upon every instance of cutting the thread as required.

(2) Also, the vertical position of the feed dog 6 may be detected by a dedicated feed dog position sensor, and the feed dog position detection unit may be configured to detect the vertical position of the feed dog 6 based on the detection signals delivered from the feed dog position sensor.

(3) Also, the feed dog 6 may be switched between the active state and the inactive state by laterally moving the contact moving member 32 by a cylinder that uses compressed air or oil pressure instead of the feed dog lowering motor 31.

The foregoing description and drawings are merely illustrative of the principles of the present disclosure and are not to be construed in a limited sense. Various changes and modifications will become apparent to those of ordinary skill in the art. All such changes and modifications are seen to fall within the scope of the disclosure as defined by the appended claims.

What is claimed is:

1. A sewing machine, comprising:

an input unit that inputs a thread cut instruction;

a thread cutting mechanism that cuts a needle thread and a bobbin thread based on the thread cut instruction;

a feed dog vertically moving mechanism that vertically drives a feed dog for feeding a workpiece cloth;

a feed dog activating switch unit that switches the feed dog between an active state in which the feed dog is vertically driven by the feed dog vertically moving mechanism and an inactive state in which an upper surface of the feed dog is positioned in a lowered position below an upper surface of a needle plate provided in a sewing machine bed;

a control unit that drives the thread cutting mechanism based on the thread cut instruction inputted from the input unit and that controls the feed dog activating switch unit to switch the feed dog to the inactive state in which the feed dog is positioned in the lowered position; and a feed dog position detection unit that detects a vertical position of the feed dog in the active state, wherein the control unit is controlled to switch the feed dog vertically moving mechanism to the inactive state when the feed dog is in the lowered position, based on an output of the feed dog position detection unit.

2. The sewing machine of claim 1, further comprising a rotational angle detection unit that detects a rotational angle of a sewing machine main shaft, wherein the feed dog vertically moving mechanism is driven in synchronization with rotation of the sewing machine main shaft and the feed dog position detection unit detects the vertical position of the feed dog based on a detection signal of the rotational angle detection unit.

3. The sewing machine of claim 1, further comprising a presser foot operating lever that switches a presser bar supporting a presser foot between a lowered position and a lifted position and an operating lever position detection unit that detects a vertical position of the presser foot operating lever, wherein when the presser foot operating lever is switched from the lifted position to the lowered position, the control unit controls the feed dog activating switch unit to switch the feed dog vertically moving mechanism to the active state based on a detection signal of the operating lever position detection unit.

4. The sewing machine of claim 1, wherein the feed dog activating switch unit includes a feed dog switch mechanism that switches the feed dog between the active state and the inactive state, and an actuator that drives the feed dog switch mechanism.

5. The sewing machine of claim 1, further comprising a mode setting unit that makes a switch between an execution mode and a non-execution mode to determine whether or not to execute a control on the feed dog activating switch unit by the control unit.

6. A control unit of a sewing machine including an input unit that inputs a thread cut instruction; a thread cutting mechanism that cuts a needle thread and a bobbin thread based on the thread cut instruction; a feed dog vertically moving mechanism that vertically drives a feed dog for feeding a workpiece cloth; a feed dog activating switch unit that switches the feed dog between an active state in which the feed dog is vertically driven by the feed dog vertically moving mechanism and an inactive state in which an upper surface of the feed dog is positioned in a lowered position below an upper surface of a needle plate provided in a sewing machine bed; and a feed dog position detection unit that detects a vertical position of the feed dog in the active state; and the control unit drives the thread cutting mechanism based on the thread cut instruction inputted from the input unit and controls the feed dog activating switch unit to switch the feed dog to the inactive state in which the feed dog is positioned in the lowered position;

wherein the feed dog vertically moving mechanism is controlled to be switched to the inactive state when the feed dog is in the lowered position, based on an output of the feed dog position detection unit.

7. The control unit of claim 6, further comprising a rotational angle detection unit that detects a rotational angle of a sewing machine main shaft, wherein the feed dog vertically moving mechanism is driven in synchronization with rotation of the sewing machine main shaft and the feed dog position detection unit detects a vertical position of the feed dog based on a detection signal of the rotational angle detection unit.

8. The control unit of claim 6, further comprising a presser foot operating lever that switches a presser bar supporting a presser foot between a lowered position and a lifted position and an operating lever position detection unit that detects a vertical position of the presser foot operating lever, wherein when the presser foot operating lever is switched from the lifted position to the lowered position, the feed dog activating switch unit is controlled to switch the feed dog vertically moving mechanism to the active state based on a detection signal of the operating lever position detection unit.

9. The control unit of claim 6, wherein the feed dog activating switch unit includes a feed dog switch mechanism that switches the feed dog between the active state and the inactive state, and an actuator that drives the feed dog switch mechanism.

10. The control unit of claim 6, further comprising a mode setting unit that makes a switch between an execution mode and a non-execution mode to determine whether or not to execute a control on the feed dog activating switch unit by the control unit.

* * * * *